US011051624B1

(12) United States Patent
Wu et al.

(10) Patent No.: US 11,051,624 B1
(45) Date of Patent: Jul. 6, 2021

(54) TWISTABLE CHAIR BACKREST FRAME

(71) Applicant: COMFORDY CO., LTD., Tainan (TW)

(72) Inventors: Yu-Ling Wu, Tainan (TW); Armin Roland Sander, Furth (DE); Cyrille Jehan Charier, Nuremberg (DE)

(73) Assignee: Comfordy Co., Ltd., Tainan (TW)

( * ) Notice: Subject to any disclaimer, the term of this patent is extended or adjusted under 35 U.S.C. 154(b) by 0 days.

(21) Appl. No.: 16/802,931

(22) Filed: Feb. 27, 2020

(51) Int. Cl.
*A47C 7/44* (2006.01)
*A47C 3/025* (2006.01)
*A47C 3/026* (2006.01)

(52) U.S. Cl.
CPC ..... *A47C 7/44* (2013.01)

(58) Field of Classification Search
CPC ..... A47C 7/44
USPC ..... 297/452.2, 285
See application file for complete search history.

(56) References Cited

U.S. PATENT DOCUMENTS 148,380 A * 3/1874 Perrenet ..... A47C 1/032 297/354.1
4,377,308 A * 3/1983 Pisanu ..... A47C 3/14 297/353
5,951,109 A * 9/1999 Roslund, Jr. ..... A47C 1/03294 297/299 X
5,967,610 A * 10/1999 Lin ..... A47C 3/18 297/183.9
6,050,646 A * 4/2000 Stenzel ..... A47C 5/06 297/218.3
6,059,363 A * 5/2000 Roslund, Jr. ..... A47C 1/03255 297/301.4
6,116,687 A * 9/2000 Vogtherr ..... A47C 7/448 297/291 X
6,910,736 B2 * 6/2005 White ..... A47C 4/028 297/284.3
7,434,879 B2 * 10/2008 Ueda ..... A47C 7/4454 297/296
7,637,570 B2 * 12/2009 Becker ..... A47C 7/28 297/314
7,640,090 B2 * 12/2009 Uchida ..... B60N 2/002 701/49
7,665,805 B2 * 2/2010 Ueda ..... A47C 1/03255 297/301.6
7,712,833 B2 * 5/2010 Ueda ..... A47C 1/03261 297/296
7,717,513 B2 * 5/2010 Ueda ..... A47C 7/444 297/300.2
7,837,272 B2 * 11/2010 Masunaga ..... A47C 7/38 297/452.56
7,862,120 B2 * 1/2011 Ueda ..... A47C 1/03261 297/297
9,079,514 B2 * 7/2015 Haller ..... B60N 2/2222
9,301,617 B2 * 4/2016 Chen ..... A47C 7/46
9,332,851 B2 * 5/2016 Machael ..... A47C 7/44
9,504,325 B2 * 11/2016 Sander ..... A47C 7/02
9,504,330 B2 * 11/2016 Gehner ..... A47C 9/002
9,713,380 B2 * 7/2017 Gehner ..... A47C 1/03277
9,975,458 B2 * 5/2018 Takeuchi ..... B60N 2/39
10,058,180 B2 * 8/2018 Desanta ..... A47C 1/032
10,064,493 B2 * 9/2018 Machael ..... A47C 7/46

(Continued)

*Primary Examiner* — Rodney B White
(74) *Attorney, Agent, or Firm* — Rosenberg, Klein & Lee

(57) ABSTRACT

A twistable chair backrest frame is disclosed herein. It has a hollow section and two opposite elastic supporting ribs at a right side and a left side of the hollow section.

11 Claims, 5 Drawing Sheets

(56) References Cited

U.S. PATENT DOCUMENTS

| | | | | |
|---|---|---|---|---|
| 10,272,282 | B2 * | 4/2019 | Harlow | A47C 7/441 |
| 10,299,595 | B2 * | 5/2019 | Diffrient | A47C 7/40 |
| 10,420,423 | B2 * | 9/2019 | Schmidt | A47C 7/44 |
| 10,537,181 | B2 * | 1/2020 | Brodbeck | A47C 7/40 |
| 2004/0012237 | A1 * | 1/2004 | Horiki | A47C 31/02<br>297/440.11 |

* cited by examiner

TWISTABLE CHAIR BACKREST FRAME

BACKGROUND OF THE INVENTION

1. Field of the Invention

The present invention relates to a twistable chair backrest frame which can produce a matching twisting action as the user's body twists so as to allow the user's back to bear against it and increase comfort when the user sits on the chair.

2. Description of Related Art

When people sit on chairs, their backs usually lean against the chair backs. However, if people lie directly on the hard chair backboards, they may easily feel back pain or discomfort. Even if a soft cushion is arranged on the surface of a hard chair backboard to increase the elasticity of the chair back, the elasticity of the soft cushion and the tilting angle of the cushion arranged on the chair backboard are still limited. As a result, when the user adjusts his/her sitting posture and twists his/her body, the chair back cannot be twisted along with the left and right twisting of the user's body and one side of the user's back will lose contact and support with the chair back.

SUMMARY OF THE INVENTION

In view of the above-mentioned problems, the object of the present invention is to provide a twistable chair backrest frame. For the effect of improving comfort and relax when the user sits on the chair, this invention produces a matching twisting action as the user's body twists so as to allow the user's back to bear against it.

The twistable chair backrest frame comprises a hollow section and two opposite elastic supporting ribs at a left side and a right side of the hollow section. Accordingly, when a user lies on the two elastic supporting ribs of the twistable chair backrest frame of the present invention, the two elastic supporting ribs of the twistable chair backrest frame can be twisted along with the left and right twisting of the user's body, so that the twistable chair backrest frame produces a matching twisting action. Thus when the user twists and stretches his/her body, his/her body's back can bear against the twistable chair backrest frame. Accordingly, the comfort and relax effects can be improved when the user sits on the chair.

DETAILED DESCRIPTION OF THE PREFERRED EMBODIMENT

Hereinafter, an exemplary embodiment of the present invention will be described in detail with reference to the accompanying drawings.

Figure 1:
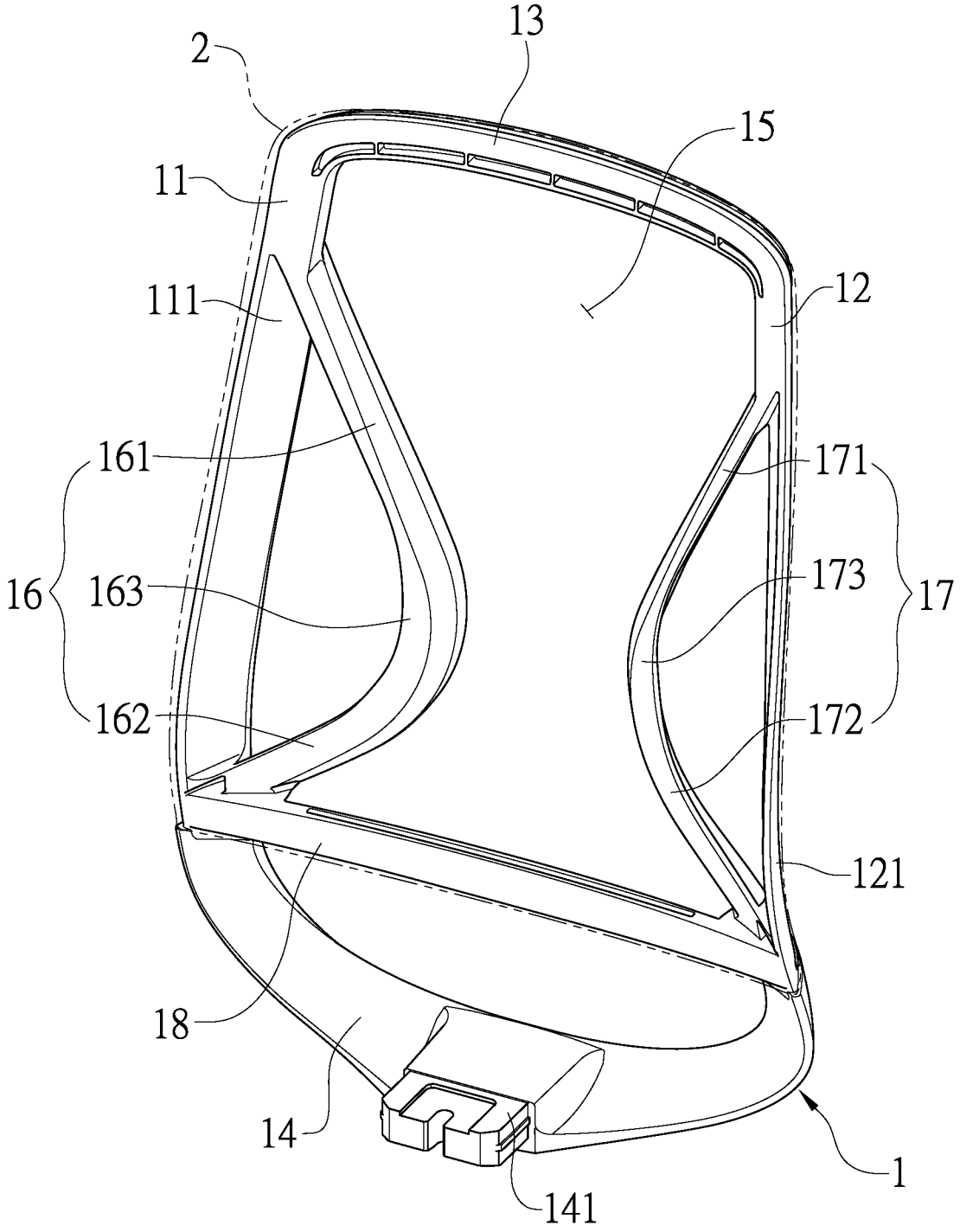
FIG. 1 is a front view showing a twistable chair backrest frame according to the present invention.
Figure 2:
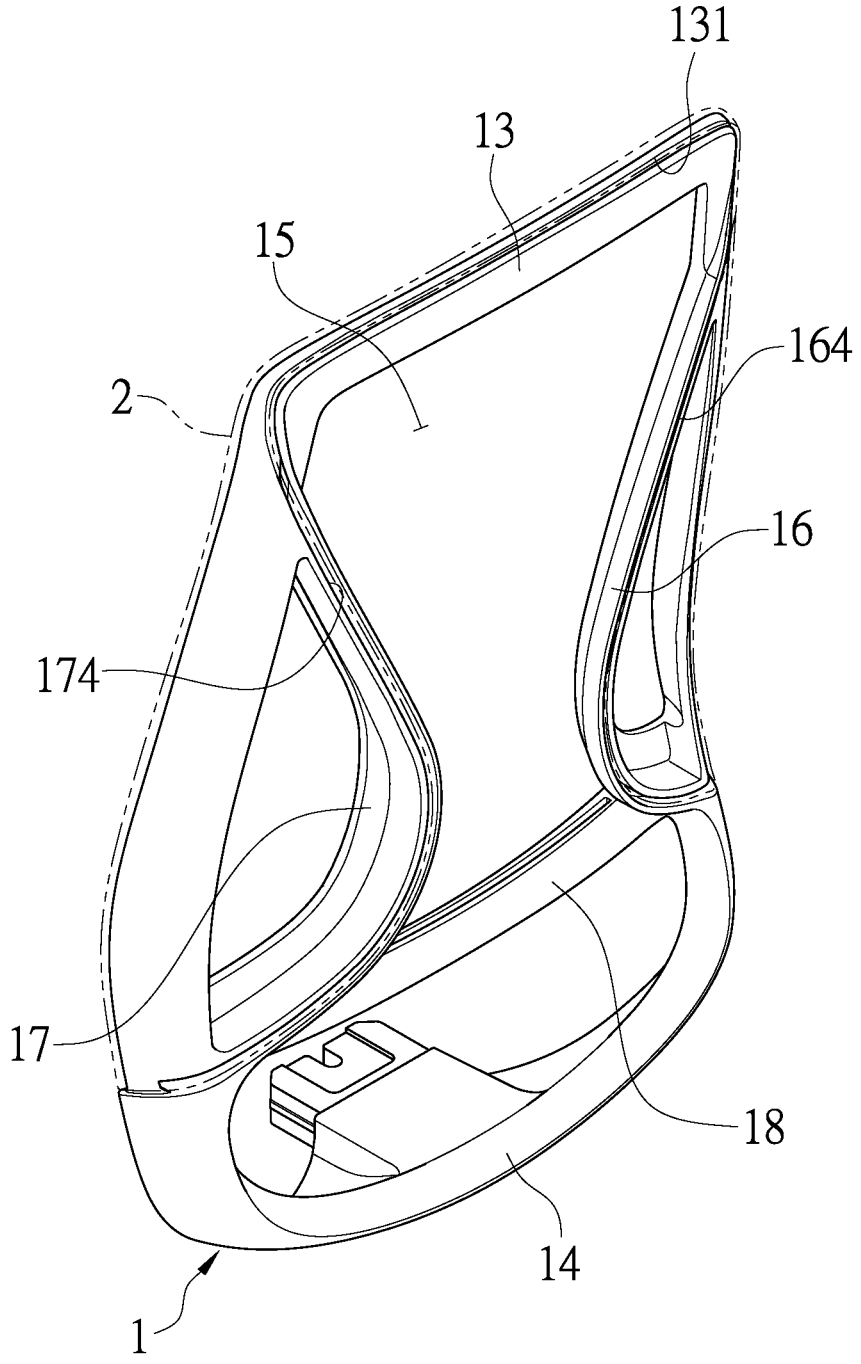
FIG. 2 is a back view showing a twistable chair backrest frame according to the present invention.

As showed in FIG. 1 and FIG. 2, a twistable chair backrest frame according to the present invention is disclosed herein. A twistable chair backrest frame (1) is made from a flexible material, e.g. polypropylene. The twistable chair backrest frame (1) comprises a first rod part (11) longitudinally disposed at a right side thereof; a second rod part (12) longitudinally disposed at a left side thereof and opposite to the first rod part (11); a third rod part (13) horizontally disposed at an upper side thereof for connecting an upper end of the first rod part (11) and an upper end of the second rod part (12); a fourth rod part (14) horizontally disposed at a lower side thereof for connecting a lower end of the first rod part (11) and a lower end of the second rod part (12); a hollow section (15) defined by the first rod part (11), the second rod part (12), the third rod part (13) and the fourth rod part (14); a first elastic supporting rib (16) integrally formed at the first rod part (11) and located at a right side of the hollow section (15); a second elastic supporting rib (17) integrally formed at the second rod part (12) with respect to the first elastic supporting rib (16) and located at a left side of the hollow section (15); and a reinforcement rib (18) transversely arranged in the hollow section (15) for connecting the lower end of the first elastic supporting rib (16) to the lower end of the second elastic supporting rib (17) and connecting the lower end of the first rod part (11) to the lower end of the second rod part (12).

Furthermore, a center of a front side of the fourth rod part (14) is provided with a coupling member (141) for connection to a portion of a chair. The first elastic supporting rib (16) comprises a first upper inclined segment (161) downwardly inclined from the upper end of the first rod part (11) toward a center of the hollow section (15), a first lower inclined segment (162) upwardly inclined from the lower end of the first rod part (11) toward the center of the hollow section (15), and a first turning segment (163) connected to the first upper inclined segment (161) and the first lower inclined segment (162) and located in proximity to the center of the hollow section (15). The second elastic supporting rib (17) comprises a second upper inclined segment (171) downwardly inclined from the upper end of the second rod part (12) toward the center of the hollow section (15), a second lower inclined segment (172) upwardly inclined from the lower end of the second rod part (12) toward the center of the hollow section (15), and a second turning segment (173) connected to the second upper inclined segment (171) and the second lower inclined segment (172) and located in proximity to the center of the hollow section (15). In this way, a middle part of the first elastic supporting rib (16) and a middle part of the second elastic supporting rib (17) are bended toward the center of the hollow section (15) and protruded from a rear side of the twistable chair backrest frame (1). Additionally, a first supporting section (111) and a second supporting section (121) are provided. The first supporting section (111) is disposed at an inner side of the first rod part (11) and extended from a junction of the upper ends of the first elastic supporting rib (16) and the first rod part (11) toward a junction of the lower ends of the first elastic supporting rib (16) and the first rod part (11), and the second supporting section (121) is disposed at an inner side of the second rod part (12) and extended from a junction of the upper ends of the second elastic supporting rib (17) and the second rod part (12) toward a junction of the lower ends of the second elastic supporting rib (17) and the second rod part (12).

Figure 3:
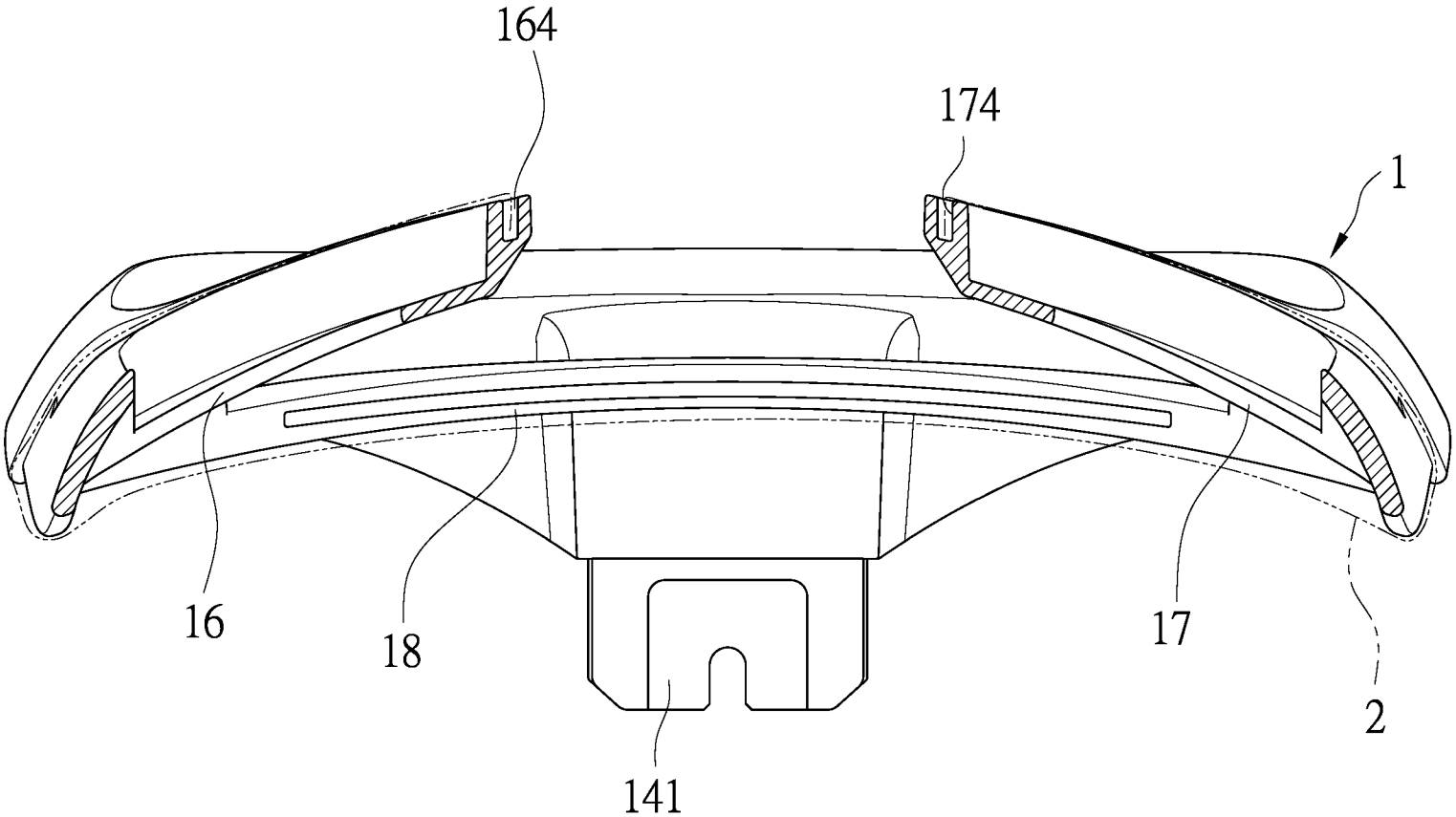
FIG. 3 is a top perspective view showing a twistable chair backrest frame according to the present invention.

Referring FIG. 3, the twistable chair backrest frame (1) is wrapped by a chair back cover (2). Preferably, the chair back cover (2) is a net cover having plural meshes. The twistable chair backrest frame (1) further comprises a first engaging groove (164), a second engaging groove (174) and a third engaging groove (131) respectively disposed at a rear side of the first elastic supporting rib (16), a rear side of the second elastic supporting rib (17) and a rear side of the third rod part (13), and a chair back cover (2). The chair back cover (2) covers a front side of the twistable chair backrest frame (1) and has a right side and a left side respectively bypassing the first supporting section (111) of the first rod part (11) and the second supporting section (121) of the second rod part (12) for respectively engaging with the first engaging groove (164) of the first elastic supporting rib (16) and the second engaging groove (174) of the second elastic supporting rib (17), an upper side engaged with the third engaging groove (131) of the third rod part (13) and a lower side extended to a bottom edge of the reinforcement rib (18). Therefore, the right side and the left side of the chair back cover (2) are tightly covered on the twistable chair backrest frame (1).

When a user sits on the chair assembled with the twistable chair backrest frame (1) of the present invention and lies on the first elastic supporting rib (16) and the second elastic supporting rib (17) of the twistable chair backrest frame (1), the first elastic supporting rib (16) and the second elastic supporting rib (17) can be twisted along with the left and right twisting of the user's body.

Figure 4:
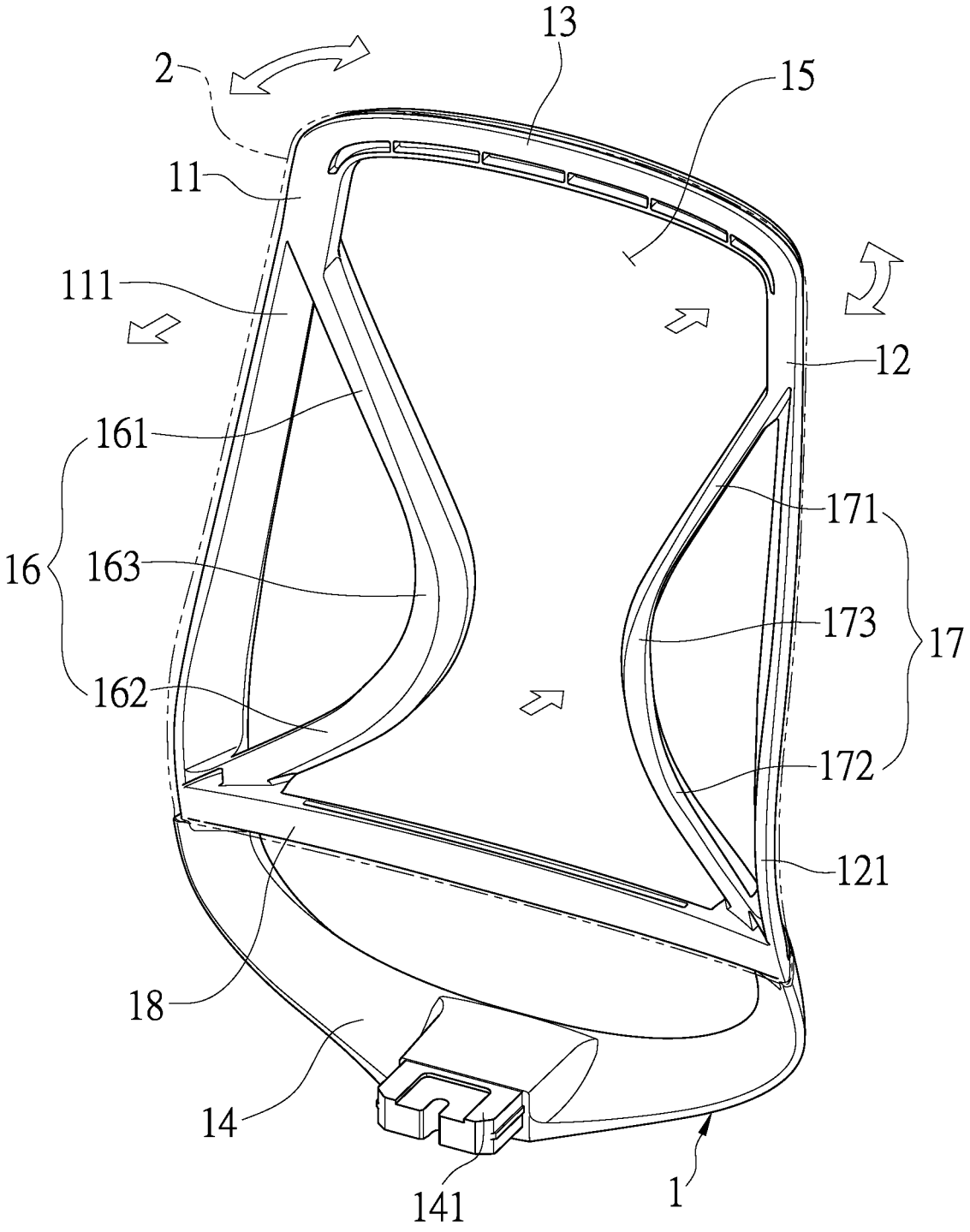
FIG. 4 is a stereogram showing a twistable chair backrest frame in use according to the present invention.
Figure 5:
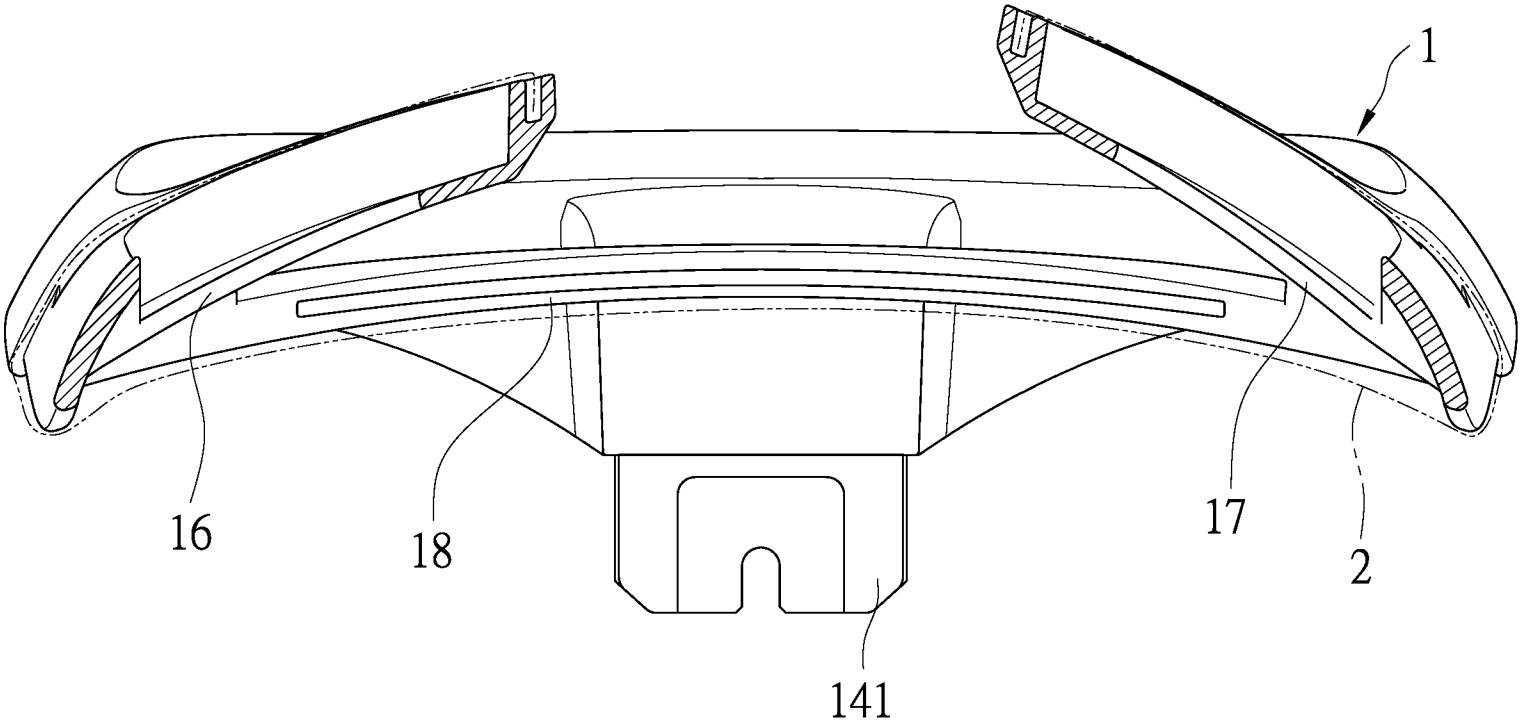
FIG. 5 is a cross-sectional view showing a twistable chair backrest frame in use according to the present invention.

Referring to FIG. 4 and FIG. 5, when the right back of the user's body moves backward, the first elastic supporting rib (16) is pressed backward. At the same time, the third rod part (13) connected to the first elastic supporting rib (16) and the second elastic supporting rib (17) drives the second elastic supporting rib (17) to move forward relatively to fit snugly the left back of the user's body. The first supporting section (111) and the second supporting section (121) respectively disposed at the inner side of the first rod part (11) and the inner side of the second rod part (12) provide the supporting effect of the first elastic supporting rib (16) and the second elastic supporting rib (17), maintain the proper elastic deformation of both, and prevent excessive distortion and deformation, thereby increasing the comfort of the user while sitting on the chair. Similarly, when the left back of the user's body moves backward, the second elastic supporting rib (17) is pressed backward. At the same time, the third rod part (13) connected to the first elastic supporting rib (16) and the second elastic supporting rib (17) drives the first elastic supporting rib (16) to move forward relatively to fit snugly the right back of the user's body. Accordingly, when the user lies on the first elastic supporting rib (16) and the second elastic supporting rib (17) of the twistable chair backrest frame (1), the two elastic supporting ribs can be twisted along with the left and right twisting of the user's body to keep the user's back bear against the twistable chair backrest frame (1).

Additionally, the hot air can be discharged from the mesh on the chair back cover (2) (e.g. net cover) through the hollow section (15) of the twistable chair backrest frame (1). Therefore, the twistable chair backrest frame (1) is breathable, which prevents the user's back from being stuffy and sweating and improves the comfort and relax effects when the user sits on the chair.

The foregoing embodiments or drawings do not limit the implementation of the twistable chair backrest frame of the present invention. Preferably, in addition to the net cover, the chair back cover (2) can also be a fabric cover which has a thin layer of foam cotton at an inner side.

What is claimed is:

1. A twistable chair backrest frame, made from a flexible material, comprising:

a first rod part longitudinally disposed at a right side thereof;

a second rod part longitudinally disposed at a left side thereof and opposite to the first rod part;

a third rod part horizontally disposed at an upper side thereof for connecting an upper end of the first rod part and an upper end of the second rod part;

a fourth rod part horizontally disposed at a lower side thereof for connecting a lower end of the first rod part and a lower end of the second rod part;

a hollow section defined by the first, second, third and fourth rod parts;

a first elastic supporting rib integrally formed at the first rod part and located at a right side of the hollow section, the first elastic supporting rib having a center part bent toward the a center of the hollow section and protruded from a rear side of the twistable chair backrest frame; and a second elastic supporting rib integrally formed at the second rod part with respect to the first elastic supporting rib and located at a left side of the hollow section, the second elastic supporting rib having a center part bent toward the a center of the hollow section and protruded from a rear side of the twistable chair backrest frame.

2. The twistable chair backrest frame as claimed in claim 1, further comprising the first elastic supporting rib having an upper end and a lower end for respectively connecting at the upper end and the lower end of the first rod part, the second elastic supporting rib having an upper end and a lower end for respectively connecting at the upper end and the lower end of the second rod part, a first supporting section disposed at an inner side of the first rod part and extended from a junction of the upper ends of the first elastic supporting rib and the first rod part toward a junction of the lower ends of the first elastic supporting rib and the first rod part, and a second supporting section disposed at an inner side of the second rod part and extended from a junction of the upper ends of the second elastic supporting rib and the second rod part toward a junction of the lower ends of the second elastic supporting rib and the second rod part.

3. The twistable chair backrest frame as claimed in claim 2, wherein the first elastic supporting rib comprises a first upper inclined segment downwardly inclined from the upper end of the first rod part toward the center of the hollow section, a first lower inclined segment upwardly inclined from the lower end of the first rod part toward the center of the hollow section, and a first turning segment connected to the first upper inclined segment and the first lower inclined segment and located in proximity to the center of the hollow section, and wherein the second elastic supporting rib comprises a second upper inclined segment downwardly inclined from the upper end of the second rod part toward the center of the hollow section, a second lower inclined segment upwardly inclined from the lower end of the second rod part toward the center of the hollow section, and a second turning segment connected to the second upper inclined segment and the second lower inclined segment and located in proximity to the center of the hollow section.

4. The twistable chair backrest frame as claimed in claim 2, further comprising a reinforcement rib transversely arranged in the hollow section for connecting the lower end of the first elastic supporting rib to the lower end of the second elastic supporting rib and connecting the lower end of the first rod part to the lower end of the second rod part.

5. The twistable chair backrest frame as claimed in claim 4, further comprising a first engaging groove, a second engaging groove and a third engaging groove respectively disposed at a rear side of the first elastic supporting rib, a rear side of the second elastic supporting rib and a rear side of the third rod part, and a chair back cover, and wherein the chair back cover covers a front side of the twistable chair backrest frame and has a right side and a left side bypassing the first supporting section of the first rod part and the second supporting section of the second rod part of the twistable chair backrest frame for respectively engaging with the first engaging groove of the first elastic supporting rib and the second engaging groove of the second elastic supporting rib, an upper side engaged with the third engaging groove and a lower side extended to a bottom edge of the reinforcement rib.

6. The twistable chair backrest frame as claimed in claim 1, wherein a center of a front side of the fourth rod part has a coupling member extending therefrom for connection to a portion of a chair.

7. The twistable chair backrest frame as claimed in claim 1, further comprising a first engaging groove, a second engaging groove and a third engaging groove respectively disposed at a rear side of the first elastic supporting rib, a rear side of the second elastic supporting rib and a rear side of the third rod part, and a chair back cover, and wherein the chair back cover covers a front side of the twistable chair backrest frame and has a right side and a left side bypassing the first rod part and the second rod part of the twistable chair backrest frame for respectively engaging with the first engaging groove of the first elastic supporting rib and the second engaging groove of the second elastic supporting rib, and an upper side engaged with the third engaging groove.

8. The twistable chair backrest frame as claimed in claim 1, further being wrapped by a chair back cover.

9. The twistable chair backrest frame as claimed in claim 8, wherein the chair back cover is a net cover or a fabric cover.

10. A twistable chair backrest frame, made from a flexible material, comprising:

a first rod part longitudinally disposed at a right side thereof;

a second rod part longitudinally disposed at a left side thereof and opposite to the first rod part;

a third rod part horizontally disposed at an upper side thereof for connecting an upper end of the first rod part and an upper end of the second rod part;

a fourth rod part horizontally disposed at a lower side thereof for connecting a lower end of the first rod part and a lower end of the second rod part;

a hollow section defined by the first, second, third and fourth rod parts;

a first elastic supporting rib integrally formed at the first rod part and located at a right side of the hollow section, the first elastic supporting rib having an upper end and a lower end for respectively connecting at the upper end and the lower end of the first rod part;

a second elastic supporting rib integrally formed at the second rod part with respect to the first elastic supporting rib and located at a left side of the hollow section, the second elastic supporting rib having an upper end and a lower end for respectively connecting at the upper end and the lower end of the second rod part;

a first supporting section disposed at an inner side of the first rod part and extended from a junction of the upper ends of the first elastic supporting rib and the first rod part toward a junction of the lower ends of the first elastic supporting rib and the first rod part; and a second supporting section disposed at an inner side of the second rod part and extended from a junction of the upper ends of the second elastic supporting rib and the second rod part toward a junction of the lower ends of the second elastic supporting rib and the second rod part.

11. A twistable chair backrest frame, made from a flexible material, comprising:

a first rod part longitudinally disposed at a right side thereof;

a second rod part longitudinally disposed at a left side thereof and opposite to the first rod part;

a third rod part horizontally disposed at an upper side thereof for connecting an upper end of the first rod part and an upper end of the second rod part;

a fourth rod part horizontally disposed at a lower side thereof for connecting a lower end of the first rod part and a lower end of the second rod part;

a hollow section defined by the first, second, third and fourth rod parts;

a first elastic supporting rib integrally formed at the first rod part and located at a right side of the hollow section;

a second elastic supporting rib integrally formed at the second rod part with respect to the first elastic supporting rib and located at a left side of the hollow section;

a first engaging groove, a second engaging groove and a third engaging groove respectively disposed at a rear side of the first elastic supporting rib, a rear side of the second elastic supporting rib and a rear side of the third rod part; and a chair back cover, wherein the chair back cover covers a front side of the twistable chair backrest frame and has a right side and a left side bypassing the first rod part and the second rod part of the twistable chair backrest frame for respectively engaging with the first engaging groove of the first elastic supporting rib and the second engaging groove of the second elastic supporting rib, and an upper side engaged with the third engaging groove.

* * * * *